US012344430B2

(12) United States Patent
Baumeister

(10) Patent No.: US 12,344,430 B2
(45) Date of Patent: Jul. 1, 2025

(54) VERTICAL FLOW WRAPPER WITH AN ASYMMETRICAL FORM SHOULDER

(71) Applicant: GEA Food Solutions Weert B.V., RV Weert (NL)

(72) Inventor: Bruno Gerfried Baumeister, Aachen (DE)

(73) Assignee: GEA FOOD SOLUTIONS WEERT B.V., RV Weert (NL)

( * ) Notice: Subject to any disclaimer, the term of this patent is extended or adjusted under 35 U.S.C. 154(b) by 0 days.

(21) Appl. No.: 18/034,896

(22) PCT Filed: Nov. 2, 2021

(86) PCT No.: PCT/EP2021/080369

§ 371 (c)(1),
(2) Date: May 2, 2023

(87) PCT Pub. No.: WO2022/096453

PCT Pub. Date: May 12, 2022

(65) Prior Publication Data

US 2024/0017863 A1 Jan. 18, 2024

(30) Foreign Application Priority Data

Nov. 4, 2020 (EP) ..... 20205665

(51) Int. Cl.
*B65B 9/20* (2012.01)
*B65B 9/22* (2006.01)
*B65B 61/18* (2006.01)

(52) U.S. Cl.
CPC ..... *B65B 9/2035* (2013.01); *B65B 9/22* (2013.01); *B65B 61/188* (2013.01)

(58) Field of Classification Search
None
See application file for complete search history.

(56) References Cited

U.S. PATENT DOCUMENTS 4,709,533 A * 12/1987 Ausnit ..... B29C 66/4722 53/139.2
5,042,224 A * 8/1991 McMahon ..... B65B 9/22 53/139.2
5,046,300 A * 9/1991 Custer ..... B65B 9/213 53/139.2

(Continued)

FOREIGN PATENT DOCUMENTS

WO 2020/078869 A1 4/2020

OTHER PUBLICATIONS

International Search Report and Written Opinion dated Apr. 2, 2022, for International Application PCT/EP2021/080369.

(Continued)

*Primary Examiner* — Tanzim Imam
(74) *Attorney, Agent, or Firm* — The Dobrusin Law Firm, P.C.

(57) ABSTRACT

A vertical flow-wrapper, which produces packages from a packaging material, the vertical flow-wrapper includes: a form-fill tube, a form shoulder, a longitudinal-sealing means, a cross-sealing means/cutting means, and means to attach a reclosure means to the packaging material, the form shoulder is an asymmetrical form shoulder and the means are at least partially provided within vertical boundaries of the asymmetrical form shoulder.

15 Claims, 4 Drawing Sheets

(56) References Cited

U.S. PATENT DOCUMENTS

| | | | | |
|---|---|---|---|---|
| 5,215,380 | A * | 6/1993 | Custer | B29C 66/8491 383/203 |
| 5,425,216 | A | 6/1995 | Ausnit | |
| 2002/0020152 | A1 | 2/2002 | Kuhn et al. | |
| 2003/0093971 | A1* | 5/2003 | Terminella | B29C 66/849 53/133.4 |
| 2012/0085479 | A1* | 4/2012 | Goto | B65B 9/2028 156/538 |
| 2017/0233125 | A1* | 8/2017 | Brenkus | B65B 61/188 53/416 |

OTHER PUBLICATIONS

International Preliminary Report on Patentability dated Feb. 22, 2023, for International Application PCT/EP2021/080369.

Chinese Office Action dated Apr. 7, 2025, for Chinese patent application No. 2021800746693.

* cited by examiner

VERTICAL FLOW WRAPPER WITH AN ASYMMETRICAL FORM SHOULDER

CROSS-REFERENCE TO RELATED APPLICATIONS

This application is a US national stage of PCT/EP2021/080369 filed on Nov. 2, 2021, which claims priority to EP 20205665.1 filed on Nov. 4, 2020, all of which are hereby incorporated by reference herein for all purposes.

FIELD

The invention relates to improvements of a vertical flow-wrapper, which produces packages from a packaging material, with a form-fill-tube with a form shoulder, with a longitudinal-sealing means, with a cross-sealing means/cutting means and with means to attach a reclosure means to the packaging material. The invention also relates to methods to produce a package from a plane packaging material.

BACKGROUND

A common method of making packages out of a packaging material web is the use of a vertical flow-wrapper. Such a packaging machine receives a continuous flat sheet, for example a film of plastic material, e.g. a thermoplastic material, paper or a paper-like material, which is transported continuously or intermittently and passed downwardly over a form shoulder and thereby shaped into a tubular form, i.e. into a packaging material tube, which is wrapped around a vertical form-fill tube of the packaging machine. After being wrapped around the vertical form-fill tube, the packaging material web is longitudinally closed by means of a longitudinally extending seal which is applied to the packaging material especially by heat sealing the lateral/longitudinal margins of the packaging material web or by heat sealing in the vicinity of these margins thereby joining them. This is carried out by so called longitudinal-sealing means. The packaging material tube has conventionally a rectangular, elliptical or a circular cross-sectional area or any other area. Conventionally, the packaging material tube is closed by cross-sealing means, preferably in a direction perpendicular to the direction of flow of the packaging material, i.e. transversely. Thereby, individual packages are defined out of the continuous packaging material tube. A product, such as a foodstuff, is introduced by dropping the product through the form-fill tube and into the packaging material tube surrounding the form-fill-tube. During filling, the packaging material tube is transversely open at its upper end, i.e. not cross-sealed. Thereafter and/or simultaneously, the packaging material tube together with the product is moved downwardly and then a top cross-seal is formed above the product and thereby a hermetically closed package produced. As a last step or simultaneously to the application of the top seal, the package is separated from the packaging material tube by cutting means. Nowadays, packages often comprise reclosure means, which must be attached to the packaging material.

SUMMARY

The purpose of the invention is therefore to provide a vertical flow-wrapper and a method to attach the reclosure means to the packaging material.

The purpose is attained by providing a vertical flow-wrapper, which produces packages from a packaging material, with a form-fill-tube with a form shoulder, with a longitudinal-sealing means, with a cross-sealing means/cutting means and with means to attach a reclosure means to the packaging material, wherein the form shoulder is an asymmetrical form shoulder and wherein the means to attach the reclosure means to the packaging material is at least partially provided within the vertical boundaries of the asymmetrical form shoulder.

The disclosure regarding this embodiment of the present invention also applies to the inventive methods and vice versa. Subject matters disclosed regarding the vertical flow-wrapper can be included into the inventive methods and vice versa.

The present invention relates to a vertical flow-wrapper with a frame and/or a housing, which receives a continuous flat sheet, e.g. a film of plastic material, e.g. a thermoplastic material, e.g. a paper or a paper-like material, which is transported continuously or intermittently and passed downwardly over a form shoulder and is thereby shaped into a tubular form, i.e. into a packaging material tube which is wrapped around a vertical form-fill tube of the packaging machine. After being wrapped around the vertical form-fill tube, the packaging material web is longitudinally closed by means of a longitudinally extending seal which is applied to the packaging material especially by heat sealing the lateral/longitudinal margins of the packaging material web or by heat sealing in the vicinity of these margins thereby joining them. This is carried out by so called longitudinal-sealing means. The packaging material tube has conventionally a rectangular, elliptical or a circular cross-sectional area or any other area. Conventionally, the packaging material tube is closed by cross-sealing means, preferably in a direction perpendicular to the direction of flow of the packaging material, i.e. transversely. Thereby, individual packages are defined out of the continuous packaging material tube. A product, such as a foodstuff, is introduced into the packaging material tube by dropping the product through the form-fill tube and into the packaging material tube surrounding the form-fill tube and onto a lower-, first cross seal. During filling the packaging material tube is transversely open at its upper-, top end, i.e. not cross-sealed. Thereafter and/or simultaneously, the packaging material tube together with its product is moved downwardly and then a top cross-seal is formed above the product and thereby the hermetically closed package produced. As a last step or simultaneously to the application of the top seal, the package is separated from the packaging material tube by cutting means.

In order to reclose a once opened package, the inventive vertical flow-wrapper comprises means to attach reclosure means to the packaging material. The reclosure means can, for example, be sealed or glued to the packaging material. The reclosure means is for example a zipper. The reclosure means is preferably provided parallel to the longitudinal seal. The reclosure means preferably comprise two parts, preferably with a male and female section, which can reversibly be separated and connected. The reclosure means can be attached to the packaging material as a string or as separate segments.

According to the present invention, the form shoulder which forms the packaging material is an asymmetrical form shoulder. An asymmetrical form shoulder according to the invention does not have a vertical symmetry plane, particularly no symmetry plane which extends along a center plane of the form-fill tube.

Furthermore, according to the present invention, the asymmetrical form shoulder has vertical boundaries, e.g. relative to the direction of the force of gravity an upper- and a lower end. Inventively, the means to attach the reclosure means to the packaging material is provided at least partially, preferably entirely, within these vertical boundaries, e.g. within the upper- and the lower end.

The means to attach the reclosure means to the packaging material is any means which fixes the reclosure means to the packaging material either preliminary or permanently. Preferably, the connection between the reclosure means and the packaging material is a material bond, preferably a heat-seal. Preferably, the means to attach the reclosure means to the packaging material comprise heating means for the packaging material and/or heating means for the reclosure material and/or pressing means. At least one, preferably all of these means is/are provided between the vertical boundaries of the asymmetrical form shoulder. The heating means heat the reclosure means and/or the packaging material. Preferably, there is a separate means to heat the reclosure means and a separate means to heat the packaging material, which preferably can be controlled independently. The pressing means press the reclosure means and the packaging material together, in order to facilitate or improve the material bond, preferably the seal between the reclosure means and the packaging material. The pressing means is preferably one or more pressing roller(s).

The two parts of the reclosure means are preferably provided to the inventive vertical flow-wrapper in a connected state, e.g. the male part of the reclosure means is inserted into the female part. According to a preferred embodiment of the present invention, within the boundaries of the asymmetrical form shoulder, a material bond is only created between one part of the reclosure means and the packaging material, while the other part of the reclosure means is not attached to the packaging material.

According to a preferred embodiment of the present invention, the vertical flow-wrapper comprises further means to attach a reclosure means to the packaging material, which is located below the vertical boundaries of the asymmetrical form shoulder and/or downstream from the asymmetrical form shoulder. Preferably, this means is provided in a location parallel to the longitudinal sealing means, so that the further attachment of the reclosure means to the packaging material and the application of the longitudinal seal takes place at least partially simultaneously. The further means preferably completes and/or improves the initial attachment of the reclosure means at the packaging material. By this means, the two parts of the reclosure means are both connected, preferably permanently, to the packing material, preferably on opposite sides of the packaging material tube or opposite sides the resulting package.

According to a preferred embodiment of the present invention, the asymmetrical form shoulder comprises a vertical section and/or an essentially vertical section. Preferably, the heating means for the packaging material and/or the pressing means is/are provided in or adjacent to this vertical section of the asymmetrical form shoulder.

Preferably, the means to attach the reclosure means to the packaging material is not attached, particularly directly not connected to the asymmetrical form shoulder and/or to the form-fill tube.

The problem is also solved with a method to produce a package from a plane packaging material, which is formed by an asymmetrical form shoulder into a packaging material tube, whose distal ends are connected by a longitudinal sealing means with a longitudinal seal, wherein a first cross seal is provided at the packaging material tube by cross-sealing means and wherein the packaging material tube is filled with a product before a second cross seal is provided at the packaging material tube and the filled packages are separated from the packaging material tube by cutting means and wherein a reclosure means is provided parallel to the longitudinal seal, wherein the reclosure means is attached to packaging material within vertical boundaries of the asymmetrical form shoulder.

The disclosure regarding this embodiment of the present invention also applies to the inventive methods and vice versa. Subject matters disclosed regarding the vertical flow-wrapper can be included into the inventive methods and vice versa.

The present invention relates to a method to operate a vertical flow-wrapper with a frame and/or a housing, which receives a continuous flat sheet, e.g. a film of plastic material, e.g. a thermoplastic material, e.g. a paper or a paper-like material, which is transported continuously or intermittently and passed downwardly over a form shoulder and is thereby shaped into a tubular form, i.e. into a packaging material tube which is wrapped around a vertical form-fill tube of the packaging machine. After being wrapped around the vertical form-fill tube, the packaging material web is longitudinally closed by means of a longitudinally extending seal which is applied to the packaging material especially by heat sealing the lateral/longitudinal margins of the packaging material web or by heat sealing in the vicinity of these margins thereby joining them. This is carried out by so called longitudinal-sealing means. The packaging material tube has conventionally a rectangular, elliptical or a circular cross-sectional area or any other area. Conventionally, the packaging material tube is closed by cross-sealing means, preferably in a direction perpendicular to the direction of flow of the packaging material, i.e. transversely. Thereby, individual packages are defined out of the continuous packaging material tube. A product, such as a foodstuff, is introduced into the packaging material tube by dropping the product through a form-fill tube and into the packaging material tube surrounding the form-fill tube and onto a lower-, first cross seal. During filling the packaging material tube is transversely open at its upper-, top end, i.e. not cross-sealed. Thereafter and/or simultaneously, the packaging material tube together with its product is moved downwardly and then a top cross-seal is formed above the product and thereby the hermetically closed package produced. As a last step or simultaneously to the application of the top seal, the packages are separated from the packaging material tube by cutting means.

In order to reclose a once opened package, the inventive vertical flow-wrapper comprises means to attach reclosure means to the packaging material. The reclosure means can, for example, be sealed or glued to the packaging material. The reclosure means is for example a zipper. The reclosure means is preferably provided parallel to the longitudinal seal. The reclosure means preferably comprise two parts, preferably with a male and female section, which can reversibly be separated and connected. The reclosure means can be attached to the packaging material as a string or as separate segments.

According to the present invention, the form shoulder is an asymmetrical form shoulder. An asymmetrical form shoulder according to the invention does not have a vertical symmetry plane, particularly no symmetry plane which extends along a center plane of the form-fill tube.

Furthermore, according to the present invention, the asymmetrical form shoulder has vertical boundaries, e.g. relative to the direction of the force of gravity an upper- and a lower end. Inventively, the means to attach the reclosure means to the packaging material is provided within these vertical boundaries, e.g. within the upper- and the lower end. The reclosure means is attached to the packaging material while it passes the asymmetrical form shoulder.

The means to attach the reclosure means to the packaging material is any means which fixes the reclosure means to the packaging material either preliminary or permanently. Preferably, the connection between the reclosure means and the packaging material is a material bond, preferably a heat-seal. Preferably, the means to attach the reclosure means to the packaging material comprise heating means for the packaging material and/or heating means for the reclosure material and/or pressing means. At least one, preferably all of these means is/are provided between the vertical boundaries of the asymmetrical form shoulder. The heating means heat the reclosure means and/or the packaging material. Preferably, there is a separate means to heat the reclosure means and a separate means to heat the packaging material, which preferably can be controlled independently. The pressing means press the reclosure means and the packaging material together, in order to facilitate or improve the material bond, preferably the seal between the reclosure means and the packaging material. The pressing means is preferably one or more pressing roller(s).

The two parts of the reclosure means are preferably provided to the inventive vertical flow-wrapper in a connected state, e.g. the male part of the reclosure means is inserted into the female part. According to a preferred embodiment of the present invention, within the boundaries of the asymmetrical form shoulder, a material bond is only created between one part of the reclosure means and the packaging material, while the other part of the reclosure means is not attached to the packaging material.

According to another inventive or preferred embodiment of the present invention, the reclosure means are attached to the packaging material, while the packaging material is being formed by asymmetrical form shoulder.

The disclosure regarding this embodiment of the present invention also applies to the inventive methods and vice versa. Subject matters disclosed regarding the vertical flow-wrapper can be included into the inventive methods and vice versa.

Regarding this embodiment of the present invention, the reclosure means is attached to the packaging material, while the packaging material is still being formed by the asymmetrical form shoulder, i.e. while the forming of the plane packaging material into a packaging material tube has already started and before it is completed.

Preferably, the reclosure means are attached to a part of the packaging material that moves vertically within the asymmetrical form shoulder.

Preferably, the reclosure means are further attached to the packaging material by means, preferably sealing means, which is located below the vertical boundaries of the asymmetrical form shoulder and/or downstream from the asymmetrical form shoulder. This means preferably completes and/or improves the initial attachment of the reclosure means at the packaging material. By this means, the two parts of the reclosure means are both connected, preferably permanently, to the packing material, preferably on opposite sides of the packaging material tube or opposite sides of the resulting package.

The invention is now explained referring to the Figures of the attached drawings, by way of non-limiting examples. The explanations apply to the inventive apparatus and the inventive methods likewise.

DETAILED DESCRIPTION

Figure 1:
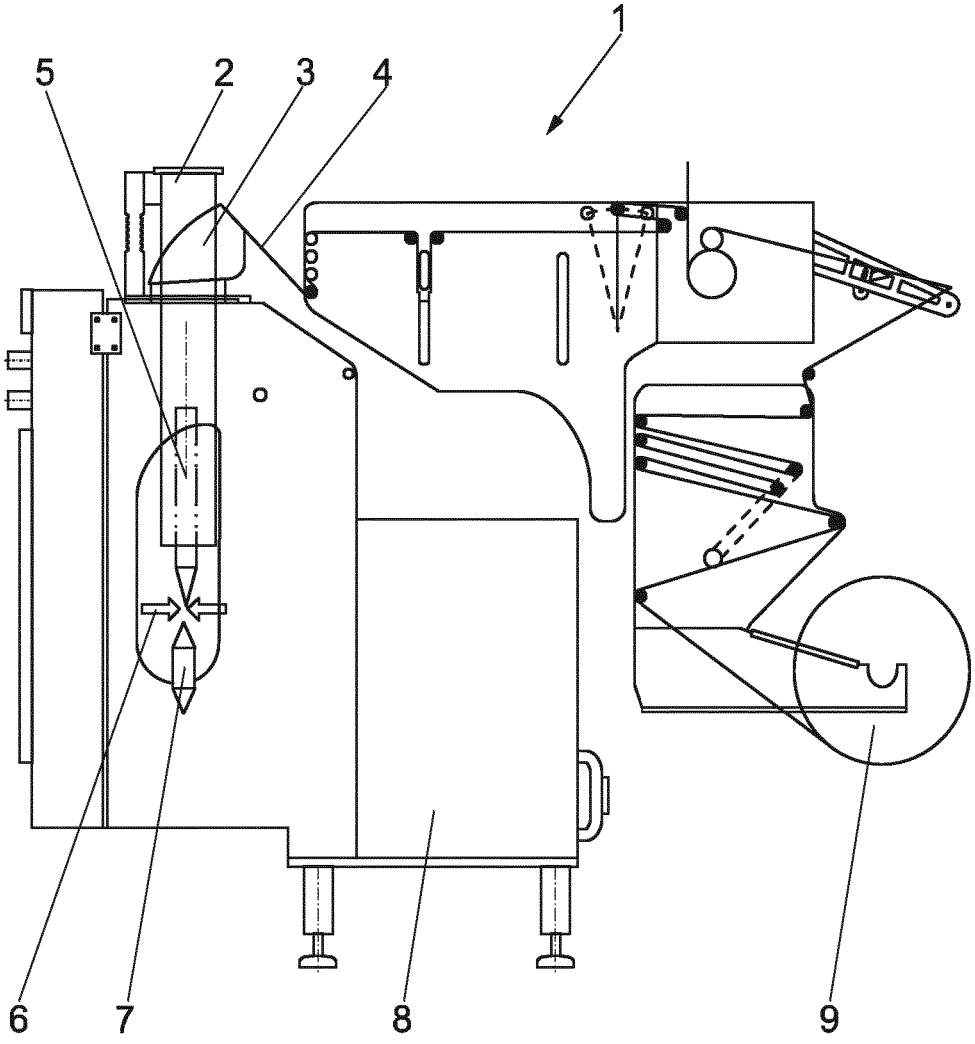
FIG. 1 shows schematically the vertical flow-wrapper according to the invention.

In FIG. 1, the vertical flow-wrapper 1 according to the invention is schematically shown. A vertical flow wrapper is a packaging machine, which forms a plane packaging material web 4, for example a film web, into a packaging material tube, which is formed by a form shoulder 3 into a packaging material tube which is transported vertically downward along a form-fill tube 2. As can be seen particularly in FIGS. 2 and 3, the form shoulder is an asymmetrical form shoulder. Two ends of this packaging material tube are sealed together by a longitudinal sealing means 5. Subsequently, a packaging item is filled into the packaging material tube and a cross-seal is applied by cross-sealing means 6 to the packaging material tube to close the package. Simultaneously or after applying the cross-seal, the finalized packages are cut off the packaging material tube. The vertical flow-wrapper may comprise gusset-forming means to form the bottom and/or the top of each package.

The web of a packaging material 4, especially a weldable plastic film 4, is supplied from a reel 9, which supplies the plane packaging material continuously or intermittently to a form shoulder 3, which shapes the packaging material web into a rather tubular form around a form-fill tube 2. In the context of the present invention, a "tubular form" of the packages or of the packaging material means any cross-sectional form including a circular form or another form, and especially a rectangular or generally a polygonal form. Longitudinal sealing means 5, which are provided downstream from the form shoulder, seal the edges to the packaging material tube together. Finally, cross seals, extending preferably perpendicularly to the direction of flow of the package material, are applied, especially by means of cross-sealing means 6. These cross-sealing means 6 do not only apply an upper/second cross-seal closing the top of the package 7, but these cross-sealing means 6 advantageously also provide, preferably simultaneously, a lower/first cross-seal defining the bottom of the subsequent, upstream package 7. The packages 7 produced are separated from one another by a cutting means, which are preferably incorporated into the cross-sealing means 6. Between the application of the bottom- and top-cross-seal of each package, the package is filled with the product, preferably an edible product.

According to the present invention, reclosure means 11, for example a zipper, is attached to the packaging material. This attachment, preferably a pre-attachment, is carried out by means 10, 12, 13 as specifically depicted in FIGS. 2*a*, 2*b* and FIGS. 3*a*, 3*b*. The reclosure means 11 are preferably provided in parallel to the longitudinal seal 18 as can be seen in FIG. 4.

Figure 2A:
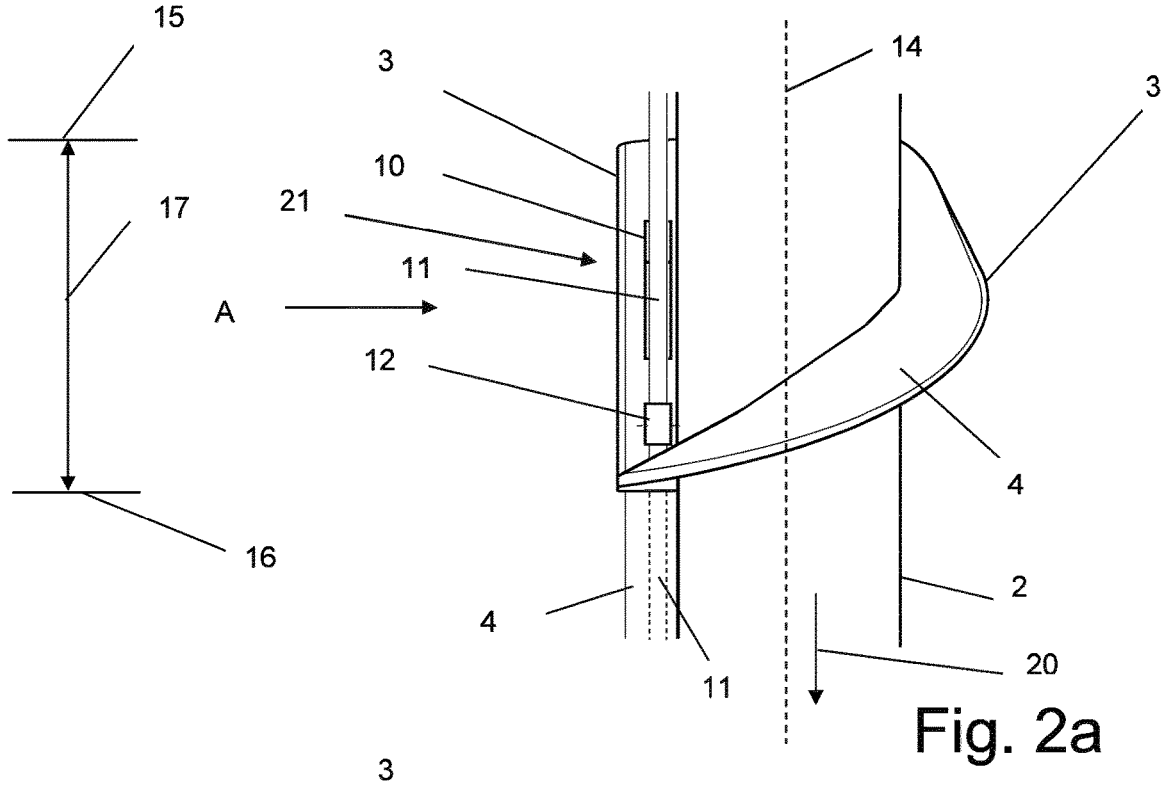
FIGS. 2*a* and 2*b* show a first embodiment of the inventive flow-wrapper.
Figure 2B:
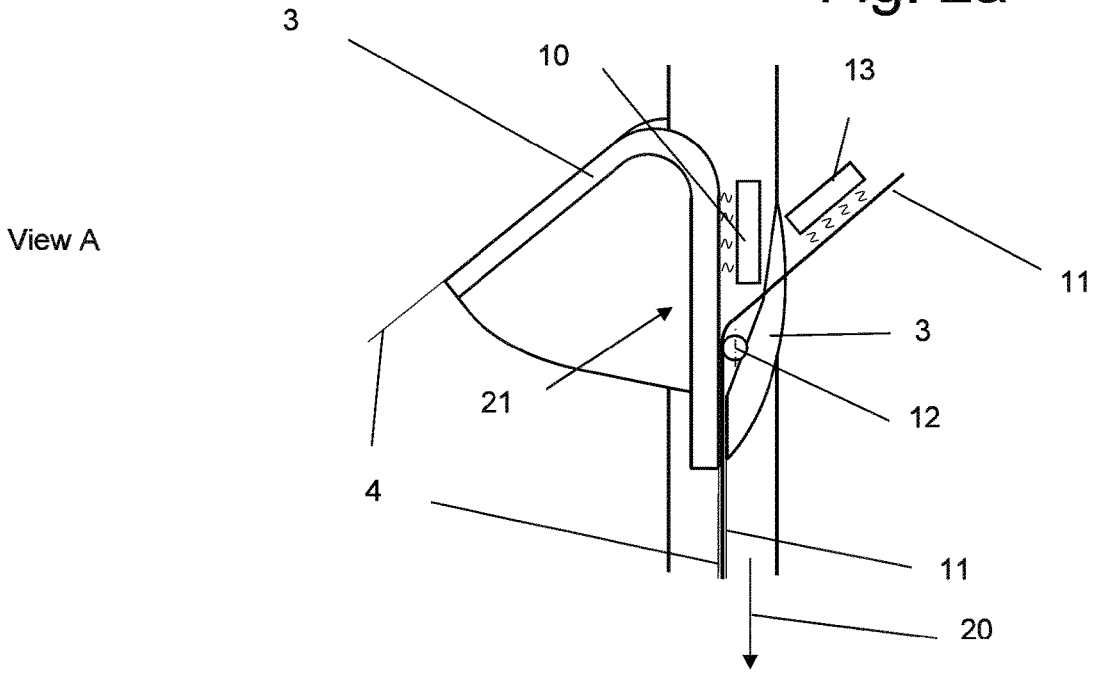

FIGS. 2*a* and 2*b* show details of a first embodiment of the inventive flow-wrapper 1 or the inventive methods. In FIG. 2*b* the "view A" shown in FIG. 2*a* is depicted. An asymmetrical form shoulder 3 is provided, here at a form-fill tube 2, which is oriented vertically as shown in these Figures. The direction of the force of gravity is oriented from the top of the Figures to their bottom. The asymmetrical 3 form shoulder does not have a vertical symmetry plane, particularly no vertical symmetry plane in the vertical center axis 14 of form-fill tube. As can be particularly seen from FIG. 2*a*, the part of the asymmetrical form shoulder on the left hand side of a vertical symmetry plane along the vertical center axis 14 is different from the part of the asymmetrical form shoulder on the right hand side of a vertical symmetry plane along the vertical center axis 14. As can be further seen particularly from FIG. 2*a*, the asymmetrical form shoulder has a vertical extension 17, which is delimited by the upper boundary or upper end 15 and the low boundary or lower end 16. Furthermore, the asymmetrical form shoulder preferably has a straight vertical or a straight essentially vertical section 21. The packaging material 4 which is initially a plane web is drawn over the asymmetrical form shoulder 3 and thereby formed into a packaging material tube which extends around the form fill tube 2. Downstream from the asymmetrical form shoulder 3, the packaging material tube is transported vertically downwards as depicted by arrow 20. The transportation of the packaging material tube can be continuously or intermittent.

According to the present invention, the inventive vertical flow wrapper comprises means 10, 12, 13 to attach a reclosure means 11, for example a zipper, to the packaging material 4. Normally, the reclosure means comprise two parts, which can be reversibly joined together to close the package or separated to open the package. The attachment provided by the means 10, 12, 13 can be preliminary or the final attachment needed for the package 7. In the example according to FIGS. 2*a* and 2*b*, the zipper is provided as a continuous strip which is cut into segments after being attached to the packaging material. In the present case, the attachment of the reclosure means 11 to the packaging material 4 is carried out by heat sealing. Consequently, at least one heating means 10, 13, here two heating means 10, 13 is/are provided, which heat the reclosure means 11 and/or the packaging material 4. Furthermore, optionally, at least one pressing means 12, here a pressing roller, preferably two pressing rollers are provided, which presses the reclosure means 11 and the packaging material 4 together to facilitate or improve their material bond. The skilled person understands that depending on the materials utilized one heating means 10, 13 may be sufficient and/or the pressing means 12 can be omitted. The skilled person further understands that the means to attach the reclosure means to the packaging material may also be gluing means or any other means to attach the reclosure means to the packaging material.

The attachment of the reclosure means at the packaging material provided by the means to attach the reclosure means to the packaging material is preferably a pre-attachment, a preliminary attachment, which is further improved downstream from the asymmetrical form shoulder by further sealing means.

According to the present invention, the means to attach the reclosure means to the packaging material are now provided within the vertical boundaries 15, 16 of the asymmetrical form shoulder or within the vertical extension of the asymmetrical form shoulder. In case the means to attach the reclosure means to the packaging material comprises multiple components like in the present case components 10, 12, 13, at least one component, preferably more than one and more preferably all components 10, 12, 13 are located within these vertical boundaries.

In the present case, the heating means 10 heat the packaging material in a location in which the reclosure means shall be attached. The heating means 13 heat one surface of the reclosure means 11. Both heating means 10, 13 are here provided within the vertical boundaries of the asymmetrical form shoulder. Downstream from the heating means 10, 13 but still within the boundaries of the asymmetrical form shoulder, the heated surfaces are pressed together by one or two, preferably two pressing means, here pressing roller(s).

Preferably, the reclosure means 11 is attached to the packaging material, while the packing material is still being formed into a packaging material tube, i.e. while the reclosure means are being attached to the packaging material, the forming process of the web into a packaging material tube has started, but is not jet finalized.

According to a preferred embodiment of the present invention, the means to attach the reclosure means to the packaging material, particularly the means 10 to heat the packaging material and/or the pressing means 12 is/are provided in or adjacent to a vertical, here straight, section 21 of the asymmetrical form shoulder 3.

In the present case, even though the reclosure means comprises normally two parts as explained above, only one part of the reclosure means 11 is attached to the packaging material within the boundaries of the asymmetrical form shoulder. The inventive vertical flow wrapper therefore preferably comprises further attachment means (not depicted), preferably sealing means, which are located downstream from the asymmetrical form shoulder 3 and more preferably at least partially parallel to the longitudinal sealing means, which attach the not yet attached part of the reclosure means to the packaging material and/or even more preferably improve a pre-attachment of the reclosure means provided within the boundaries of the asymmetrical form shoulder. The further attachment of the reclosure means and the application of the longitudinal sealing means is at least partially simultaneously.

Figure 3A:
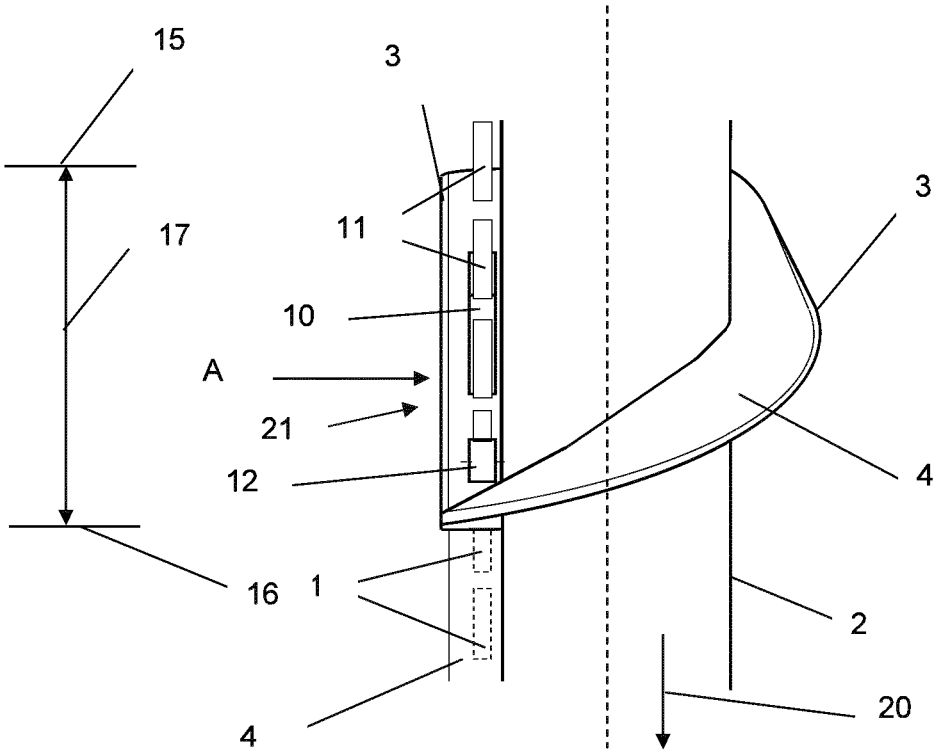
FIGS. 3*a* and 3*b* show a second embodiment of the inventive flow-wrapper.
Figure 3B:
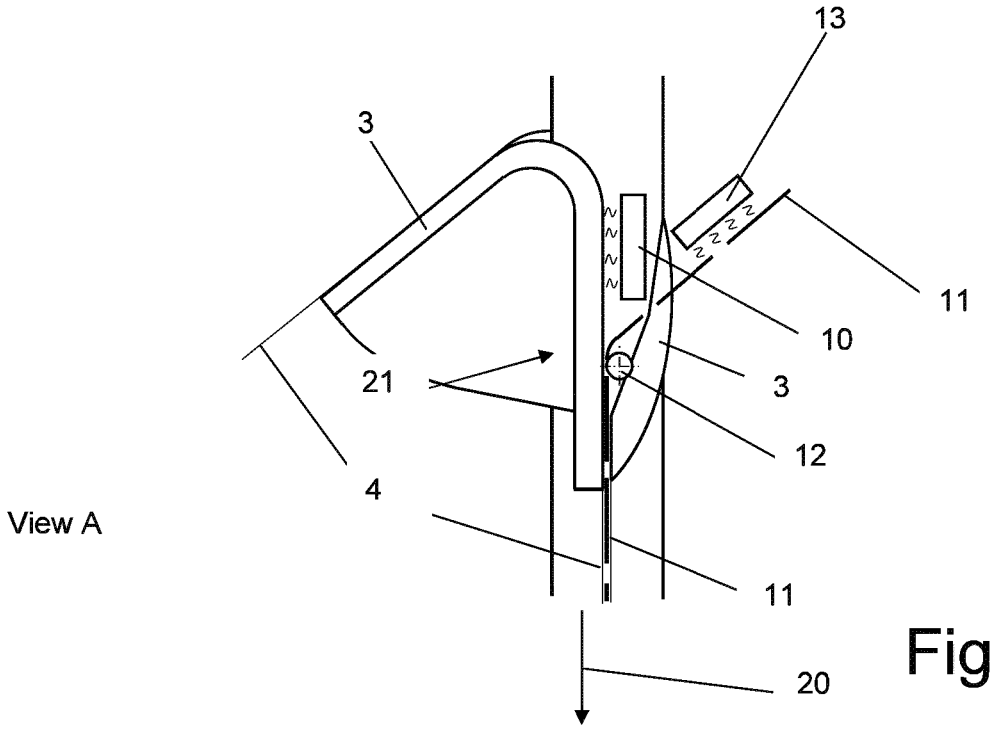
Figure 4:
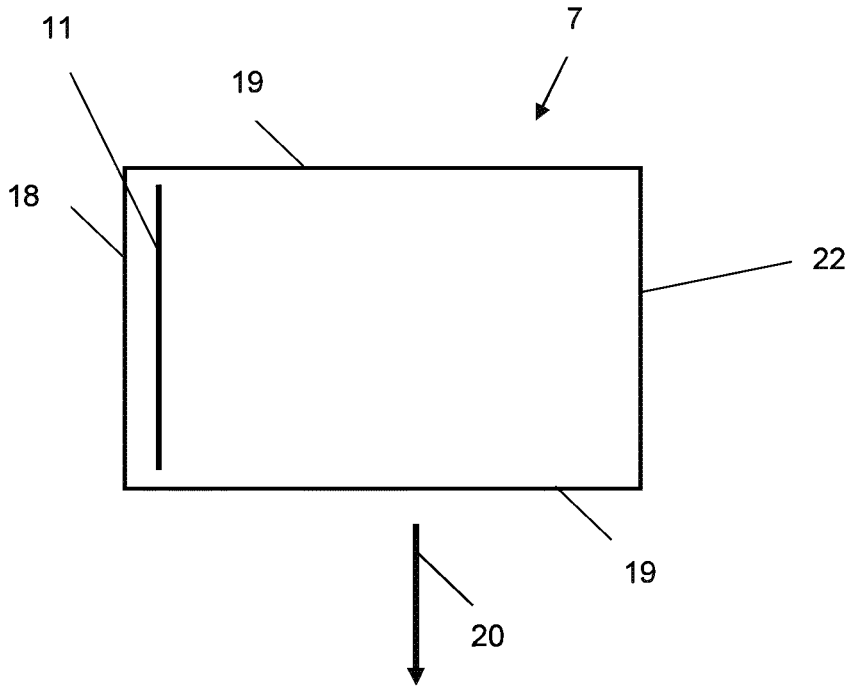
FIG. 4 shows a package that can be produced with the inventive flow wrapper and the inventive method.

FIGS. 3*a* and 3*b* show details of a second embodiment of the inventive flow-wrapper 1 or the inventive methods. In FIG. 3*b* the "view A" shown in FIG. 3*a* is depicted. In principal reference can be made to the explanations according to FIGS. 2*a* and 2*b*. However, in the present case the reclosure means is provided in segments which are attached to the packaging material 4.

FIG. 4 shows the inventive package 7, here a bag or a pouch, which can be produced by the inventive flow-wrapper and/or according to the inventive methods. Arrow 20 depicts the transport direction of the packaging material. The inventive package 7 comprises two cross seals 19, which are provided transversely to the transport direction 20 of the package material. Parallel to the transport direction of the packaging material and at the opposite end of the bottom 22 of the package 7, a longitudinal seal 18 is provided. Adjacent to the longitudinal seal 18, a re-closure means 11 is provided, which allows to re-close and re-opening the package after the longitudinal seal has been removed and/or opened. The re-closure means 11 can be provided as a segment, which is already a segment before it is attached to the packaging as depicted in the embodiment according to FIGS. 3*a* and 3*b*. The re-closure means 11 may be smaller than the length of the package in transport direction 20. The package 7 may comprise a gusset at its bottom 18.

LIST OF REFERENCE SIGNS

1 vertical flow-wrapper
2 form-fill tube
3 form shoulder, asymmetrical form shoulder
4 packaging material, film
5 longitudinal-sealing means
6 cross-sealing- and/or cutting means
7 package, pouch
8 frame/housing of the vertical flow-wrapper

9 reel
10 heating means for the packaging material
11 reclosure means, zipper
12 pressing means, pressing roller
13 heating means for the reclosure means
14 vertical center axis of the form-fill tube
15 vertical boundary of the asymmetrical form shoulder, upper end, upstream end
16 vertical boundary of the asymmetrical form shoulder, lower end, downstream end
17 vertical extension of the form shoulder
18 longitudinal seal
19 cross seal
20 transport direction of the packaging material
21 vertical section of the form shoulder
22 bottom of the package

The invention claimed is:

1. A vertical flow-wrapper which produces packages from a packaging material, the vertical flow-wrapper comprising: a form-fill tube, a form shoulder, a longitudinal-sealing means, a cross-sealing means or cutting means, and means for attaching a reclosure means to the packaging material, wherein the form shoulder is an asymmetrical form shoulder and the means for attaching the reclosure means are at least partially provided within vertical boundaries of the asymmetrical form shoulder, wherein the form-fill tube extends along a vertical center axis, and the asymmetrical form shoulder is not symmetrical about any vertical plane that extends through the vertical center axis.

2. The vertical flow-wrapper according to claim 1, wherein the means for attaching the reclosure means to the packaging material comprise heating means for the packaging material and/or heating means for the reclosure means and/or pressing means.

3. The vertical flow-wrapper according to claim 2, wherein the heating means for the packaging material and/or the heating means for the reclosure means is/are provided in or adjacent to a vertical section of the asymmetrical form shoulder.

4. The vertical flow-wrapper according to claim 1, wherein the asymmetrical form shoulder does not have a symmetry plane along a vertical extension of the form shoulder.

5. The vertical flow-wrapper according to claim 1, wherein the asymmetrical form shoulder does not have a symmetry plane that extends along a center plane or axis of the form-fill tube.

6. The vertical flow-wrapper according to claim 1, wherein a part of the asymmetrical form shoulder on one side of the vertical center axis is different from another part of the asymmetrical form shoulder on another side of the vertical center axis.

7. The vertical flow-wrapper according to claim 1, wherein the asymmetrical form shoulder is asymmetrical along a flow direction of the packaging material.

8. The vertical flow-wrapper according to claim 1, wherein a longitudinal seal is formed in a location of the packages that is not in a middle of the packages.

9. A method to produce a package from a plane packaging material, wherein the packaging material is formed by an asymmetrical form shoulder into a packaging material tube, wherein distal ends of the packaging material are connected by a longitudinal sealing means with a longitudinal seal, wherein a first cross seal is provided on the packaging material tube by cross-sealing means, wherein the packaging material tube is filled with a product before a second cross seal is provided on the packaging material tube, wherein filled packages are separated from the packaging material tube by cutting means, wherein a reclosure means is provided parallel to the longitudinal seal, wherein the reclosure means is attached to the packaging material within vertical boundaries of the asymmetrical form shoulder, wherein the packaging material tube extends along a vertical center axis, and the asymmetrical form shoulder is not symmetrical about any vertical plane that extends through the vertical center axis.

10. The method according to claim 9, wherein the reclosure means is attached to the packaging material while the packaging material is formed by the asymmetrical form shoulder.

11. The method according to claim 9, wherein the reclosure means is attached to a part of the packaging material that moves vertically.

12. The method according to claim 9, wherein the asymmetrical form shoulder does not have a symmetry plane along a vertical extension of the form shoulder.

13. The method according to claim 9, wherein the asymmetrical form shoulder does not have a symmetry plane that extends along a center plane or axis of a form-fill tube.

14. The method according to claim 9, wherein a part of the asymmetrical form shoulder on one side of the vertical center axis is different from another part of the asymmetrical form shoulder on another side of the vertical center axis.

15. The method according to claim 9, wherein the asymmetrical form shoulder is asymmetrical along a flow direction of the packaging material.

* * * * *